US008139804B2

(12) United States Patent
Wendell et al.

(10) Patent No.: US 8,139,804 B2
(45) Date of Patent: Mar. 20, 2012

(54) ELECTROACOUSTIC TRANSDUCING WITH A BRIDGE PHASE PLUG

(75) Inventors: John H. Wendell, Westford, MA (US); Thomas A. Froeschle, Southborough, MA (US); Christopher B. Ickler, Sudbury, MA (US)

(73) Assignee: Bose Corporation, Framingham, MA (US)

( * ) Notice: Subject to any disclaimer, the term of this patent is extended or adjusted under 35 U.S.C. 154(b) by 304 days.

(21) Appl. No.: 12/490,463

(22) Filed: Jun. 24, 2009

(65) Prior Publication Data

US 2010/0329495 A1 Dec. 30, 2010

(51) Int. Cl.
*H04R 25/00* (2006.01)

(52) U.S. Cl. ..... 381/343; 381/340; 381/430

(58) Field of Classification Search ..... 381/337–343, 381/430; 181/152, 159, 177, 185, 192, 195
See application file for complete search history.

(56) References Cited

U.S. PATENT DOCUMENTS 4,031,337 A * 6/1977 Okamura et al. ..... 381/340
4,157,741 A 6/1979 Goldwater
4,975,965 A 12/1990 Adamson
5,117,462 A 5/1992 Bie
6,744,899 B1 6/2004 Grunberg
7,039,211 B2 * 5/2006 Werner ..... 381/343

FOREIGN PATENT DOCUMENTS

GB 2437125 A 10/2007
WO 03/084288 A1 10/2003

OTHER PUBLICATIONS

International Search Report and Written Opinion for PCT/US2010/037387 dated Aug. 19, 2010, 12 pages.

* cited by examiner

*Primary Examiner* — Huyen D Le

(57) ABSTRACT

An electro-acoustic transducer has an electro-magnetically driven moving dome and a phase plug having a body and a dome-interface surface, with a compression cavity formed between the dome and the dome-interface surface. The phase plug includes at least first and second annular slots beginning at the dome-interface surface and extending a first depth into the body of the phase plug. The first and second slots are separated by a bridge element at the dome-interface surface and joined by a first bridge passage at the first depth beneath the dome-interface surface. The phase plug also includes an exit slot coupling the bridge passage to a throat at a second depth in the body of the phase plug.

15 Claims, 8 Drawing Sheets

ELECTROACOUSTIC TRANSDUCING WITH A BRIDGE PHASE PLUG

BACKGROUND

This disclosure relates to electroacoustic transducing with a bridged phase plug.

A compression driver is a type of electroacoustic transducer in which air is compressed in a compression cavity between a moving diaphragm and a fixed phase plug. Passages in the phase plug, referred to as slots, conduct air from the compression cavity to a listening environment, generally through a throat and a horn. The horn provides impedance matching between the air in the throat and air in the free space of the listening environment and controls the directivity of the radiated sound.

Several terms are defined with reference to FIGS. 1 and 2. For reference, directions such as "top" and "bottom" or "above" and "below" refer to the drawing itself with the top and bottom margins of the drawing sheet defining up and down. As installed, a phase plug could face in any direction. In a compression driver, the primary moving element is referred to as the dome 10. In some examples, the dome is a simple spherical section. In some examples, the dome has a complex curvature. The ends of the dome are formed into or joined to a cylindrical section called the skirt 12. The skirt is joined to a voice coil former or bobbin 14 and a surround 16, which is in turn fixed to the external structure 18. In some examples, the surround is formed from an extension of the dome, not a separate part. A voice coil 20 is wound around the bobbin and reacts to a magnet 22 and pole piece 24 to move the bobbin and dome when a current or voltage is applied to the voice coil. Above the dome is a rear cavity 26 bounded by a rear cavity wall 28. Below the dome is a front or compression cavity 30 bounded by a dome-interface surface 32 of a phase plug 34. Movement of the dome compresses air in the compression cavity. In the example of FIGS. 1 and 2, the dome, skirt, bobbin, surround, external structure, voice coil, magnet, and pole piece are shown abstractly and are not meant to represent any particular design or technology.

In a typical phase plug, exemplified in FIGS. 1 and 2, one or more slots 36*a*, 36*b*, 36*c* begin at the dome-interface surface of the phase plug and join at the throat 38, communicating the pressurized air from the compression cavity 30 to the throat 38. The throat is defined as beginning at the point where the multiple slots are completely joined in a single passage. While we refer to these passages as slots, due to their appearance in a two-dimensional section (e.g., FIG. 1), they are actually cone-shaped voids in the three-dimensional phase plug, bounded on top and bottom by cones of slightly different radius (if the slots taper in width, as they do in this example) and/or vertical position. In FIG. 2, each of 36*a*, 36*b*, and 36*c* is seen twice. Given the shape of the slots, the phase plug 34 is composed of several concentric cone-shaped solids 34*a*-34*c* and an outer cylindrical solid 34*d*, all joined and held in relative position by supports (not shown) within the slots. The slots 36*a*-36*c* couple the compression cavity 30 to the throat 38, which in turn couples to a horn (see FIG. 7).

SUMMARY

In general, in some aspects, an electro-acoustic transducer has an electro-magnetically driven moving dome and a phase plug having a body and a dome-interface surface, with a compression cavity formed between the dome and the dome-interface surface. The phase plug includes at least first and second annular slots beginning at the dome-interface surface and extending a first depth into the body of the phase plug. The first and second slots are separated by a bridge element at the dome-interface surface and joined by a first bridge passage at the first depth beneath the dome-interface surface. The phase plug also includes an exit slot coupling the bridge passage to a throat at a second depth in the body of the phase plug.

Implementations may include one or more of the following features. The first and second slots may have approximately equal cross-sectional areas. The exit slot may have a cross-sectional area at the first bridge passage approximately equal to the sum of the cross sectional areas of the first and second slots. The exit slot may begin at the first bridge passage and have a cross-sectional area that increases exponentially with the length of the exit slot from the bridge passage to the throat. The first and second slots may be located at corresponding first and second radial distances from a central axis of the phase plug, the first and second radial distances corresponding to locations of first and second nulls in a standing wave excited in the compression cavity by motion of the dome. The exit slot may begin at a position along the first bridge passage corresponding to a location of a null in a standing wave in a loop including the first bridge passage, the first and second slots, and the portion of the compression cavity joining the first and second slots.

A voice-coil may be coupled to the dome and a compliant surround may couple the dome to a surrounding structure. A housing including a dome-facing surface may forms a back cavity between the dome and the dome-facing surface. A horn may be coupled to the output aperture of the phase plug. The phase plug may also include a third slot, the third slot beginning at the dome-interface surface and extending a third depth into the body of the phase plug, the third slot being separated from the second slot by a second bridge element at the dome-interface surface and joined by a second bridge passage at the third depth to the first bridge passage, and the exit slot beginning at the second bridge passage. The phase plug may also include third and fourth slots beginning at the dome-interface surface and extending a third depth into the body of the phase plug, the third and fourth slots being separated by a second bridge element at the dome-interface surface and joined by a second bridge passage at the third depth beneath the dome-interface surface, the second slot and first bridge passage being separated form the third slot and second bridge passage by a third bridge element at the dome interface surface and joined by a third bridge passage at a fourth depth beneath the third bridge element, the exit slot beginning at the third bridge passage. The first depth and the third depth may be approximately equal. The dome may be concave or convex relative to the phase plug.

Advantages include providing a smooth output response at high efficiency levels across the entire operating range of the compression driver.

Other features and advantages will be apparent from the description and the claims.

DESCRIPTION

Figure 3A:
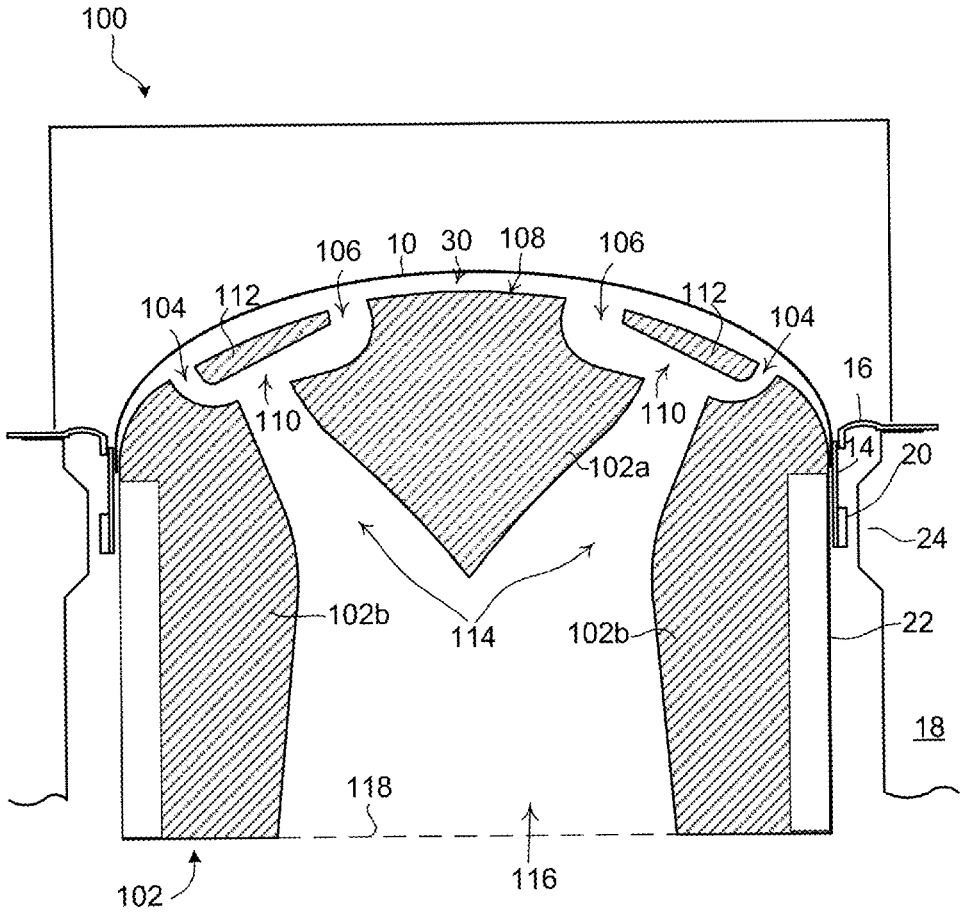
FIGS. 3A and 3B show sectional elevation views of a compression driver having a bridged phase plug.
Figure 3B:
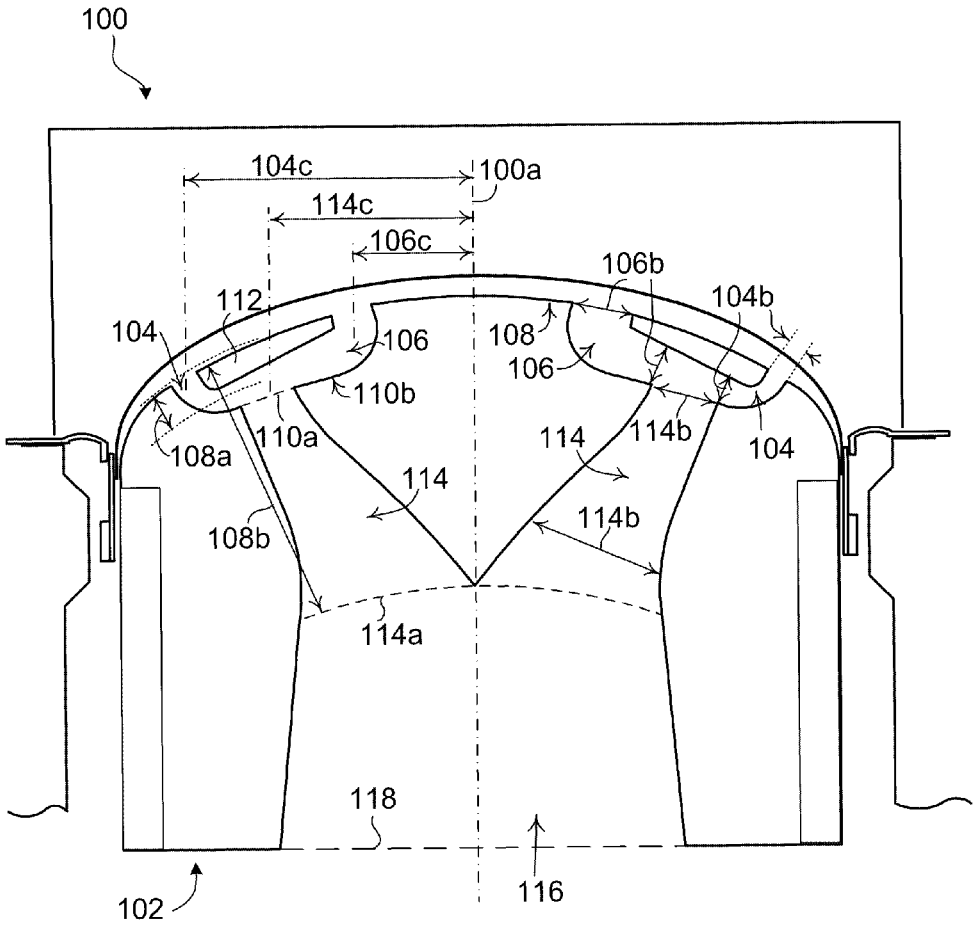
Figure 4:
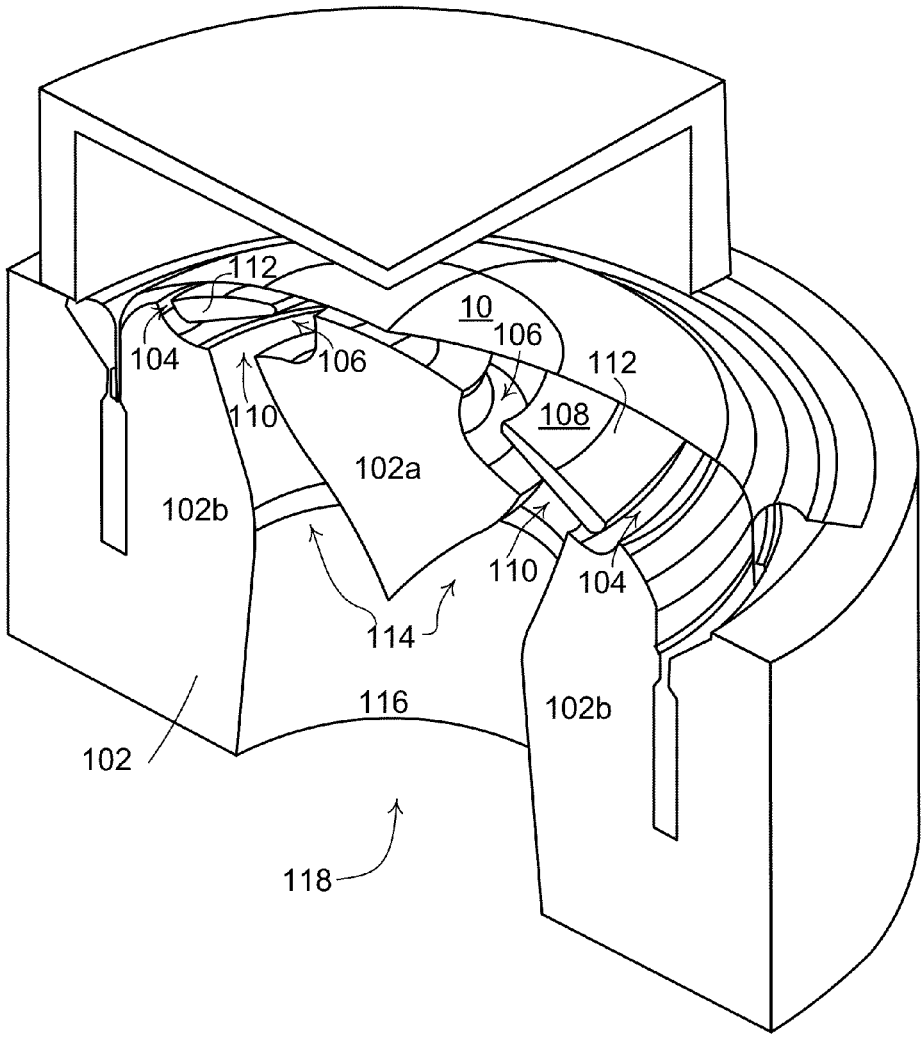
FIG. 4 shows a cut-away isometric view of a compression driver having a bridged phase plug.

An improved compression driver 100 having a bridged phase plug 102 is shown in FIGS. 3A, 3B, and 4. FIG. 3A identifies the parts of the driver while FIG. 3B includes indicators of dimensions and reference points used in describing the geometry of the parts. Reference numbers are omitted in FIG. 3B for parts not referred to in discussion of the other parts' geometry. Elements occurring on both sides of the phase plug are only labeled on one side in FIG. 3B for clarity. In the bridged phase plug 102, two slots 104 and 106 begin at the dome-interface surface 108 and extend a short depth 108*a* into the phase plug, where they join at a bridge passage 110. The bridge passage is separated from the compression volume 30 and the two slots are separated from each other by a bridge element 112. An exit slot 114 begins at the bridge passage 110 and continues through the body of the phase plug to the throat 116. The throat ends at an aperture 118. To establish points of reference, we consider the beginning of the exit slot 114 to be at the opening 110*a* where the lower wall 110*b* of the bridge volume 110 would continue if the exit slot 114 were absent. The end of the exit slot 114 and beginning of the throat 116 is the section 114*a* at a depth 108*b* below the surface 108 where the two halves (as viewed in cross-section) of the exit slot 114 join.

The dome 10, bobbin 14, surround 16, voice coil 20, and other parts external to the phase plug may not vary from the traditional compression driver design, or may be modified in other ways independent of the bridged phase plug. Modifications to the moving parts and external structure are beyond the scope of this disclosure.

Various design parameters may be modified to optimize the bridged phase plug 102 for particular performance targets, based on the acoustic attributes of the back cavity, compression cavity, and the moving parts (dome, skirt, bobbin, surround). In particular, the radii 104*c*, 106*c* of the slots 104 and 106 (measured from the centerline 100*a* of the phase plug to the centerlines 104*a*, 106*a* of the slots), the widths 104*b*, 106*b* of the slots, the radius 114*c* where the exit slot 114 joins the bridge passage 110, and the curvatures of the slots, can all be varied to obtain desired performance.

In some examples, the slots 104 and 106 are centered at radii selected to correspond to nulls in low-order axisymmetric, or radial mode, standing waves in the compression cavity induced by motion of the dome. Locating the slots at such nulls minimizes the pressure caused by cavity modes in the compression cavity. The widths of the slots 104 and 106 are selected to control a relationship between the total cross-sectional areas of the two slots. In some examples, the widths are selected so that the two slots have equal or approximately equal areas, which we refer to as a balanced bridge. The particular relationship between the areas of the two slots can be varied to obtain desired performance. In contrast, in some conventional multi-slot phase plugs, each slot's width is the same, making each slot's total area proportional to its radius. The balanced bridge design controls pressure peaking in the compression cavity without changing the slot locations. It also reduces the pressure response at the center of the compression cavity over a wide frequency band around the bridge resonance, explained in more detail below. The thickness of the bridge element 112 is tapered so that the cross-sectional areas of the two slots 104 and 106 remain approximately constant along their respective lengths, from the dome-interface surface 108 to the region where they combine and join the exit slot 114. As shown in FIG. 3B, we refer to the cross sectional area of the slots 104 and 106 by reference to the widths 104*b*, 106*b* of the slots in cross section at various positions along their lengths. Widths 104*b*, 106*b* are shown at the beginning and ends of the slots 104, 106. Similarly, the width 114*b* of the exit slot 114 is shown at the begging and end of the exit slot. These lines are revolved around the centerline 100*a* of the phase plug to find areas. The cross-sectional area of the exit slot 114 where it joins the bridge passage 110 (i.e., 110*a* in FIG. 3B) sets the compression ratio of the driver. In some examples, the areas of the slots 104 and 106 at the surface 108 and as they continue into the bridge volume are selected to match, in combination, the area of the exit slot 114 where it joins the bridge passage 110, such that the total cross sectional area of the slots from the surface 108 to the beginning (110*a*) of the exit slot 114 is constant and corresponds to the compression ratio of the driver.

The radius 114*c* where the exit slot 114 joins the bridge passage 110 is selected to correspond to a null in a low-order, e.g., first order, standing wave in the bridge passage 110. Also shown in the example of FIGS. 3A and 3B, the side-walls of exit slot 114 have a smoothly-varying curvature from the bridge passage 110 to the throat 116. Also in this example, the cross-sectional area of the exit slot 114 grows exponentially from the bridge to the throat, based on the target cutoff frequency of the driver. An exponential curvature helps decrease the length of any acoustic pathway that will be added to the compression driver before it reaches the diffraction slot of a horn. More generally, the total area of the slots changes smoothly along the length from the compression cavity to the throat and is generally constant or monotonically increasing toward the throat. This combination of locations, proportions, and curvatures results in a smooth frequency response at the throat over a wide range of frequencies, at least in cases where the dome 10 moves as a piston.

Figure 1:
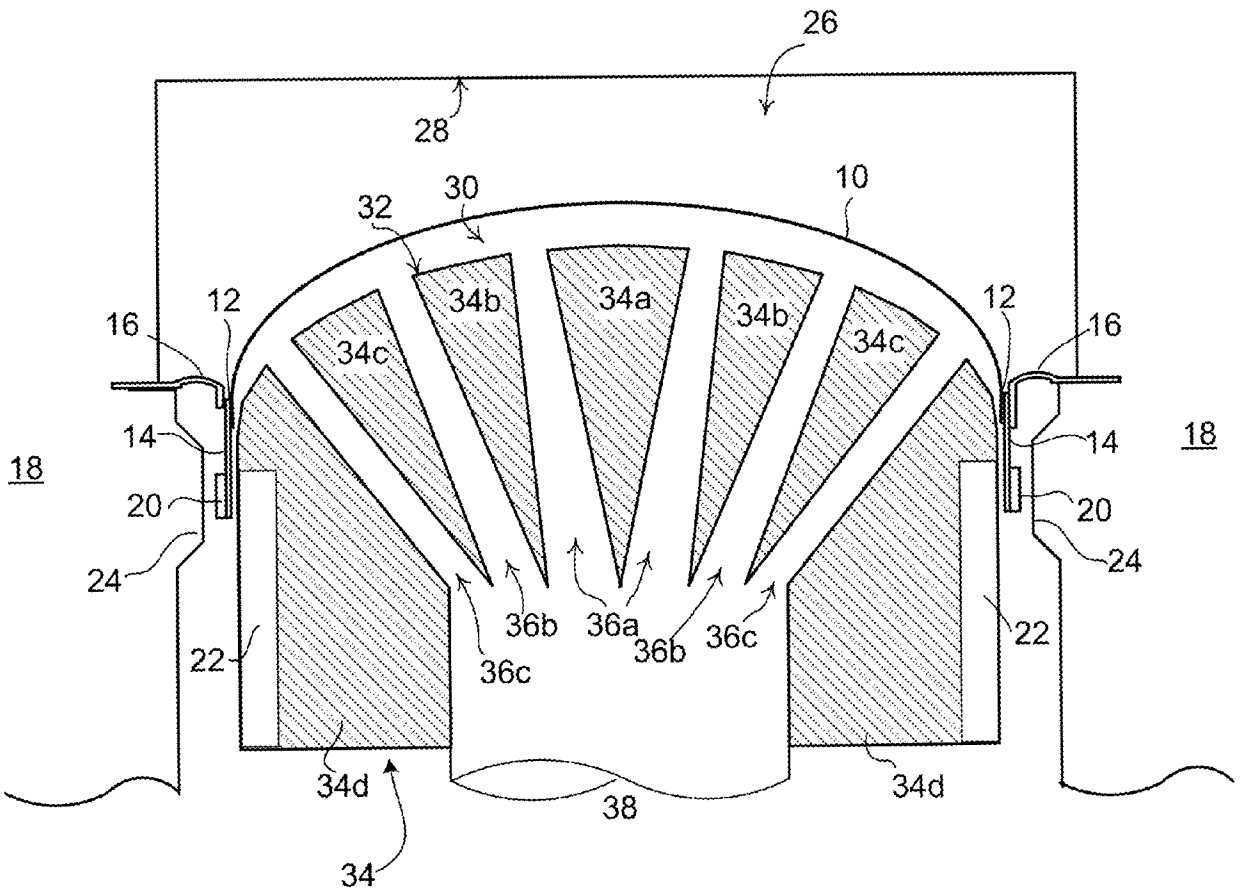
Fig. 1 (prior art)
FIG. 1 shows a sectional elevation view of a conventional compression driver.
Figure 2:
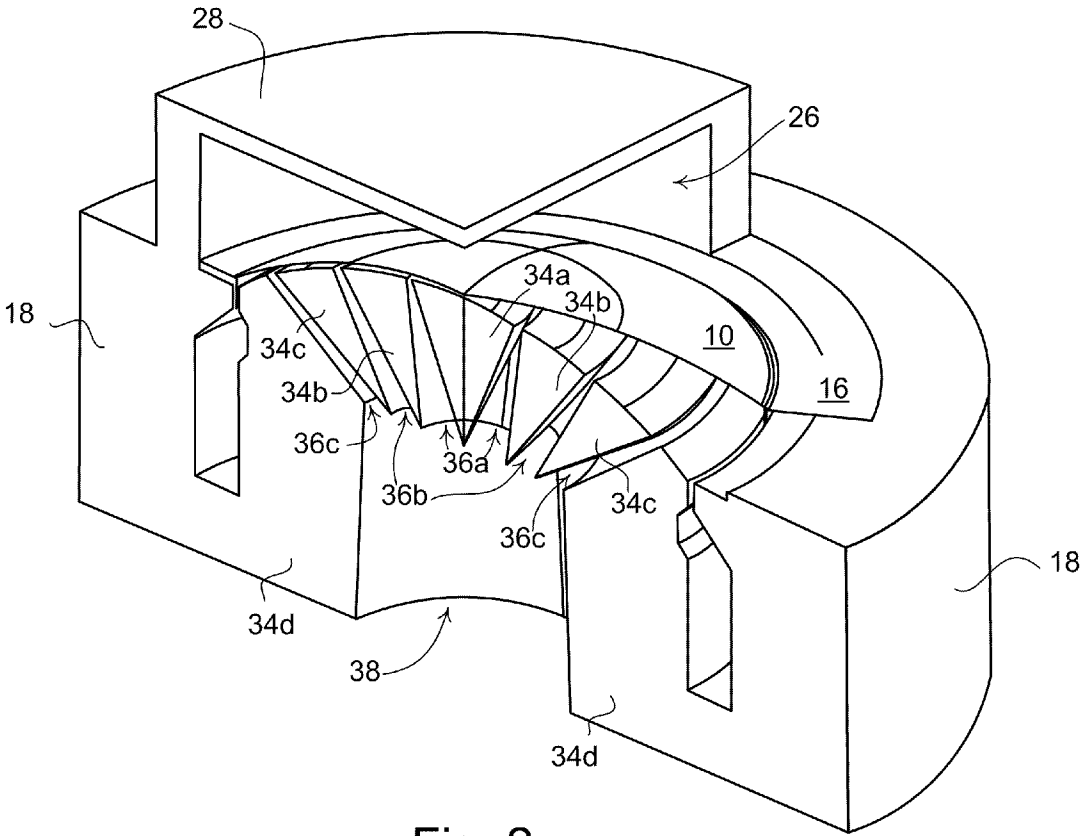
Fig. 2 (prior art)
FIG. 2 shows a cut-away isometric view of a conventional compression driver.

The balanced bridge phase plug has an additional advantage, as compared to conventional multi-slot phase plugs, of controlling loop resonances. In the conventional phase plug of FIG. 1, looping resonant waves may exist between the slots, e.g., a wave may exist in slots 36*a* and 36*b*, joined by the short section of the compression cavity 30 between the openings of those two slots. Note that such "loops" and the waves in them are complex three-dimensional shapes, not the simple paths implied by the two-dimensional cross sectional views in which they are discussed. The bridge passage 110 between the slots 104 and 106 greatly shortens the loop between those two slots, raising the resonant frequency of the loop. Raising the resonant frequency of the loops tends to move the frequency to ranges where humans are less sensitive to the peaks and dips that loop resonances cause in the response of the transducer. There also tends to be more incidental damping at higher frequencies, so the loop resonances will not be as strong. In addition to raising the resonant frequency of any loop resonances, the balanced bridge design also decreases pressure imbalances between the slots that excite the loop resonances in the first place.

Figure 6:
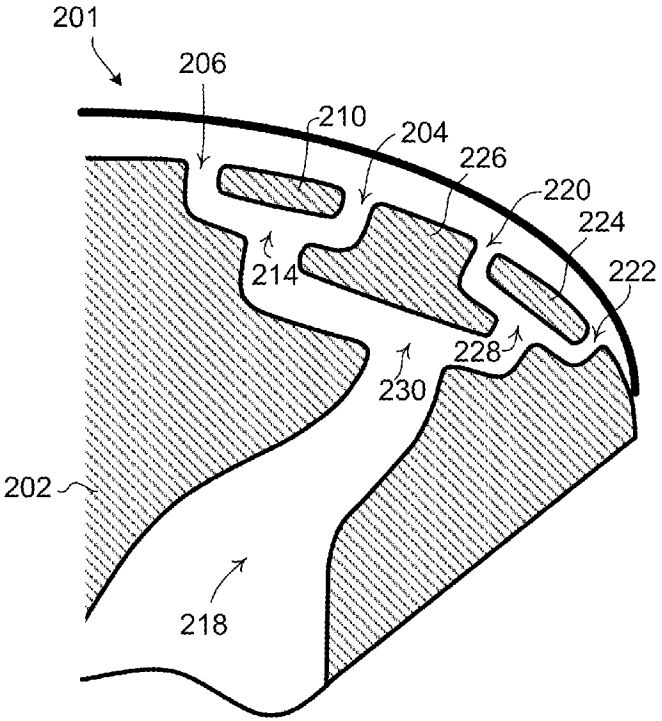
FIGS. 5 and 6 show cross-sectional elevation views of alternative embodiments of compression drivers having bridged phase plugs.
Figure 5:
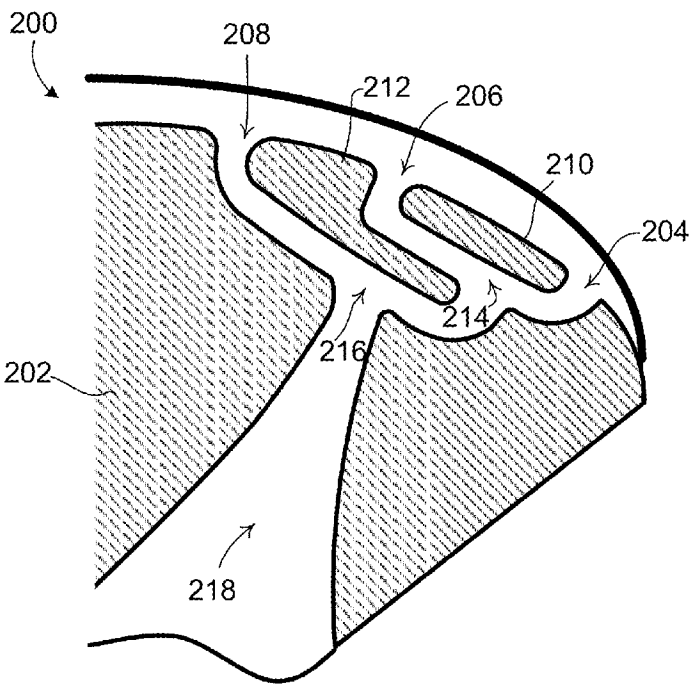

Two alternative bridged phase plug designs 200 and 201 are shown in FIGS. 5 and 6, respectively (only the right half of each section is shown). In FIG. 5, a first slot 204 and a second slot 206 are defined by a first bridge element 210 and joined by a first bridge passage 214, which is in turn joined to a third slot 208 through a second bridge passage 216 around a second bridge element 212. The exit slot 218 is joined to the second bridge passage. Alternatively, the two inner slots 206 and 208 may be joined first. In FIG. 6, the first bridged slots 204 and 206 are defined by the bridge element 210 and joined by a first bridge passage 214 as before, while a third slot 220 and a fourth slot 222 are defined by an additional bridge element 224 and joined by a second bridge passage 228. The two bridge passages 214 and 228 are separated by a third bridge element 226 and joined by a third bridge passage 230, which is joined to the exit slot 218. Each of these designs may be advantageous in particular compression driver designs, depending on the number and location of nodes in an axisymmetric standing wave of interest, which tend to be a function of the diameter of the dome and compression cavity.

Figure 7:
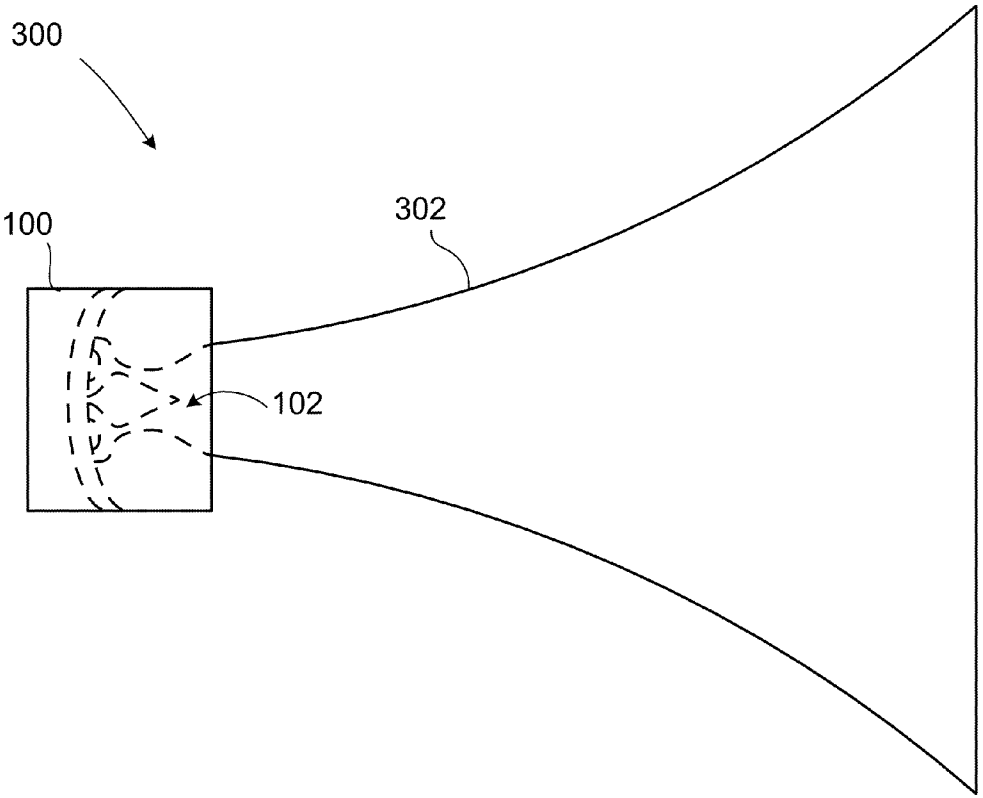
FIG. 7 shows an assembled compression driver and horn.

A sectional view of an assembled loudspeaker 300 is shown in FIG. 7. The loudspeaker includes a compression driver 100 coupled to an exponential horn 302. Other horn shapes, such as conical, hyperbolic, and tractric, may also be suitable. The bridged phase slot 102 as described above is located in the compression driver 100, with the throat of the phase plug communicating with the beginning of the horn. As noted above, the throat has an exponential curvature compatible with the curvature of the horn, based on the targeted cutoff frequency of the completed loudspeaker.

Figure 8:
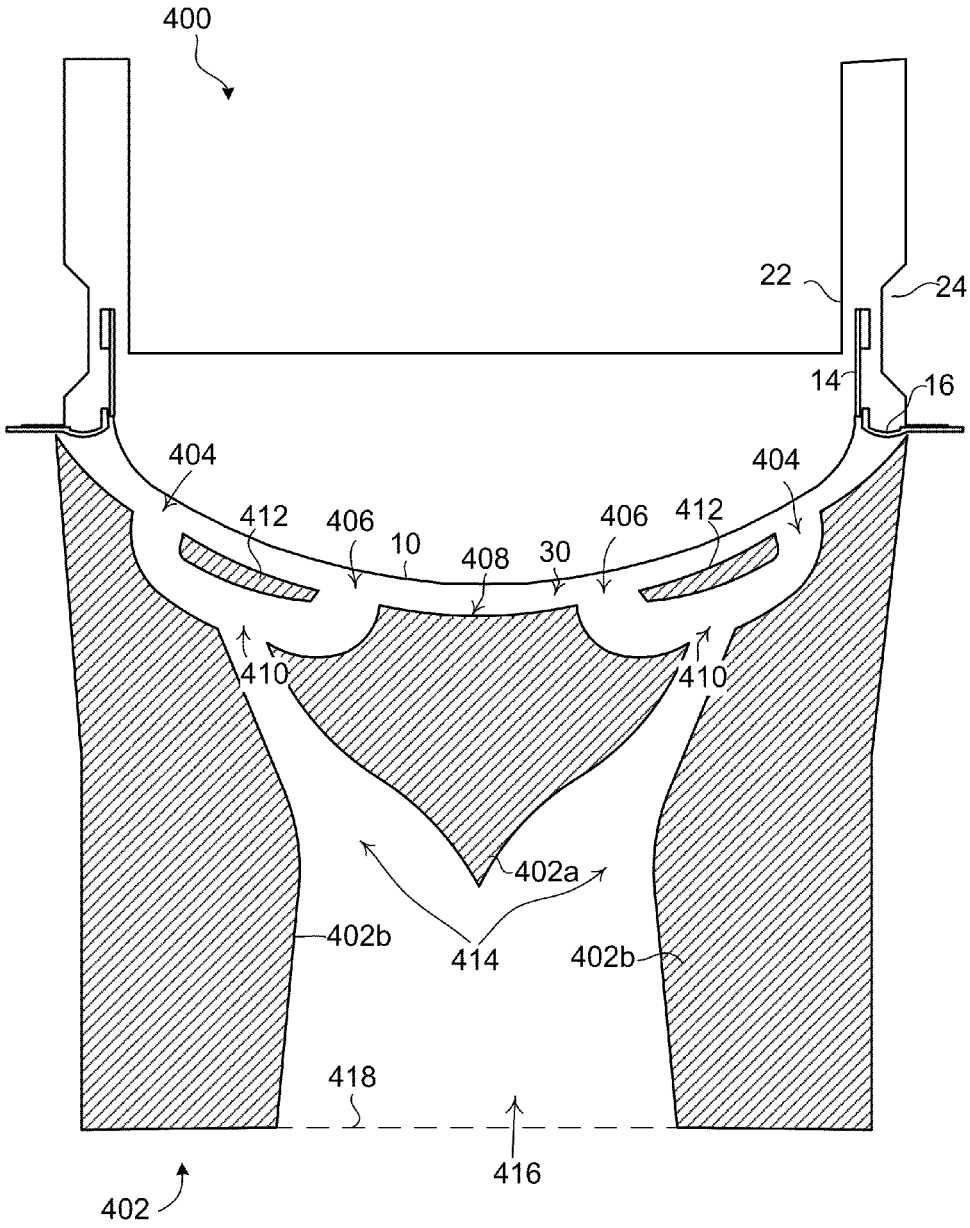
FIG. 8 shows a sectional elevation view of a compression driver having a bridged phase plug and an inverted dome.

Another embodiment 400 is shown in FIG. 8. In some examples, the dome and motor structure are inverted, such that the convex surface of the dome 10 faces a concave phase plug 402. In the example of FIG. 8, the entire dome and motor structure is inverted. In other examples, only the dome is inverted and the motor components remain on the phase plug side of the structure. In an inverted-dome design, surface normals of the dome-interface surface 408 diverge, whereas in the conventional phase plug, like that shown in FIG. 3, surface normals would have converged at the center of the sphere of which the dome-interface surface is a section. If each slot made a relatively straight path from the surface 408 to the throat 416, their lengths would increase with increasing slot radius. In a bridged phase plug, as shown, slots 404 and 406 begin at the surface and join at a bridge passage 410, separated by a bridge element 412. An exit slot 414 connects the bridged slots to the throat 416, which ends at an aperture 418. By bending the slots to form the bridge, the effective lengths of slots closer to the centerline are increased, such that all the slots have similar lengths, independent of their starting radii. This design advantageously allows the slots to match the direction of surface normals where they begin, but still join in a common throat with relatively uniform total lengths.

Other implementations are within the scope of the following claims and other claims to which the applicant may be entitled.

What is claimed is:

1. An apparatus comprising:

an electro-acoustic transducer having an electro-magnetically driven moving dome and a phase plug having a body and a dome-interface surface, with a compression cavity formed between the dome and the dome-interface surface;

the phase plug comprising at least first and second annular slots beginning at the dome-interface surface and extending a first depth into the body of the phase plug, the first and second slots being separated by a bridge element at the dome-interface surface and joined by a first bridge passage at the first depth beneath the dome-interface surface, only the first and second slots being joined by the first bridge passage, the phase plug further comprising an exit slot coupling the bridge passage to a throat at a second depth in the body of the phase plug.

2. The apparatus of claim 1 wherein the first and second slots have approximately equal cross-sectional areas.

3. The apparatus of claim 1 wherein the exit slot has a cross-sectional area at the first bridge passage approximately equal to the sum of the cross sectional areas of the first and second slots.

4. The apparatus of claim 1 wherein the exit slot begins at the first bridge passage and has a cross-sectional area that increases exponentially with the length of the exit slot from the bridge passage to the throat.

5. The apparatus of claim 1 wherein the first and second slots are located at corresponding first and second radial distances from a central axis of the phase plug, the first and second radial distances corresponding to locations of first and second nulls in a standing wave excited in the compression cavity by motion of the dome.

6. The apparatus of claim 1 wherein the exit slot begins at a position along the first bridge passage corresponding to a location of a null in a standing wave in a loop comprising the first bridge passage, the first and second slots, and the portion of the compression cavity joining the first and second slots.

7. The apparatus of claim 1 further comprising a voice-coil coupled to the dome and a compliant surround coupling the dome to a surrounding structure.

8. The apparatus of claim 1 further comprising a horn coupled to the output aperture of the phase plug.

9. The apparatus of claim 1 wherein the phase plug further comprises a third slot, the third slot beginning at the dome-interface surface and extending a third depth into the body of the phase plug, the third slot being separated from the second slot by a second bridge element at the dome-interface surface and joined by a second bridge passage at the third depth to the first bridge passage, and the exit slot beginning at the second bridge passage.

10. The apparatus of claim 1 wherein the phase plug further comprises third and fourth slots beginning at the dome-interface surface and extending a third depth into the body of the phase plug, the third and fourth slots being separated by a second bridge element at the dome-interface surface and joined by a second bridge passage at the third depth beneath the dome-interface surface, the second slot and first bridge passage being separated form the third slot and second bridge passage by a third bridge element at the dome interface surface and joined by a third bridge passage at a fourth depth beneath the third bridge element, the exit slot beginning at the third bridge passage.

11. The apparatus of claim 10 wherein the first depth and the third depth are approximately equal.

12. The apparatus of claim 1 wherein the dome is concave relative to the phase plug.

13. The apparatus of claim 1 wherein the dome is convex relative to the phase plug.

14. An apparatus comprising:

an electro-acoustic transducer having an electro-magnetically driven moving dome and a phase plug having a body and a dome-interface surface, with a compression cavity formed between the dome and the dome-interface surface;

the phase plug comprising at least first and second annular slots beginning at the dome-interface surface and extending a first depth into the body of the phase plug, the first and second slots being separated by a bridge element at the dome-interface surface and joined by a first bridge passage at the first depth beneath the dome-interface surface, the phase plug further comprising an exit slot coupling the bridge passage to a throat at a second depth in the body of the phase plug, wherein the first and second slots are located at corresponding first and second radial distances from a central axis of the phase plug, the first and second radial distances corresponding to locations of first and second nulls in a standing wave excited in the compression cavity by motion of the dome.

15. An apparatus comprising:

an electro-acoustic transducer having an electro-magnetically driven moving dome and a phase plug having a body and a dome-interface surface, with a compression cavity formed between the dome and the dome-interface surface;

the phase plug comprising at least first and second annular slots beginning at the dome-interface surface and extending a first depth into the body of the phase plug, the first and second slots being separated by a bridge element at the dome-interface surface and joined by a first bridge passage at the first depth beneath the dome-interface surface, the phase plug further comprising an exit slot coupling the bridge passage to a throat at a second depth in the body of the phase plug, wherein the exit slot begins at a position along the first bridge passage corresponding to a location of a null in a standing wave in a loop comprising the first bridge passage, the first and second slots, and the portion of the compression cavity joining the first and second slots.

* * * * *